United States Patent [19]

Ince

[11] Patent Number: 4,874,267

[45] Date of Patent: Oct. 17, 1989

[54] TUNNEL BORING MACHINE

[75] Inventor: Gordon R. Ince, Essex, England

[73] Assignee: James Howden & Company Limited, Glasgow, Scotland

[21] Appl. No.: 133,344

[22] Filed: Dec. 15, 1987

[30] Foreign Application Priority Data

Dec. 18, 1986 [GB] United Kingdom ..... 8630310

[51] Int. Cl.[4] ..... E21D 9/06

[52] U.S. Cl. ..... 405/142; 299/31; 405/147

[58] Field of Search ..... 405/141, 142, 146, 147, 405/143; 299/31, 32, 33

[56] References Cited

U.S. PATENT DOCUMENTS

| | | | |
|---|---|---|---|
| 3,345,108 | 10/1967 | Newman et al. | 299/31 |
| 3,410,098 | 11/1968 | Winberg | 405/147 X |
| 3,870,368 | 3/1975 | Winberg et al. | 299/31 |
| 3,967,463 | 7/1976 | Grandori | 405/141 |
| 4,055,959 | 11/1977 | Fritz . | |
| 4,095,435 | 6/1978 | Uemura . | |
| 4,222,681 | 9/1980 | Khodosh et al. | 405/141 |

FOREIGN PATENT DOCUMENTS

| | | |
|---|---|---|
| 1534611 | 8/1969 | Fed. Rep. of Germany . |
| 2107044 | 9/1971 | Fed. Rep. of Germany . |
| 2147883 | 3/1973 | Fed. Rep. of Germany . |
| 2852663 | 6/1980 | Fed. Rep. of Germany . |
| 2275637 | 1/1976 | France . |
| 585852 | 3/1977 | Switzerland . |
| 1477091 | 6/1977 | United Kingdom . |
| 1477092 | 6/1977 | United Kingdom . |
| 2063977 | 6/1981 | United Kingdom . |
| 2065747 | 7/1981 | United Kingdom . |

*Primary Examiner*—David H. Corbin

*Attorney, Agent, or Firm*—Fleit, Jacobson, Cohn, Price, Holman & Stern

[57] ABSTRACT

Telescopic tunnel boring machine including a front shield (10) and a rear shield (16) with a cutting head (14) at the forward end of the front shield. Rearwardly extending shutters can be moved out hydraulically by auxillary cylinders (54) from the rear end of the rear shield to bridge the gap (34) between this rear end and tunnel lining elements (32). Additionally expandable cuffs (70) and (72) may be provided on the front and rear shields respectively behind the cutting head (14) and radial tunnel wall grippers (20).

11 Claims, 3 Drawing Sheets

Fig.1.
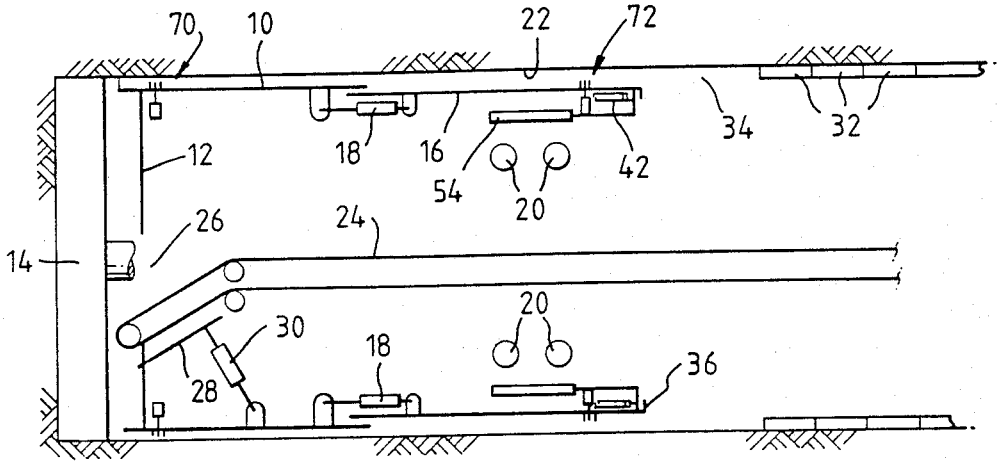
Fig.4.
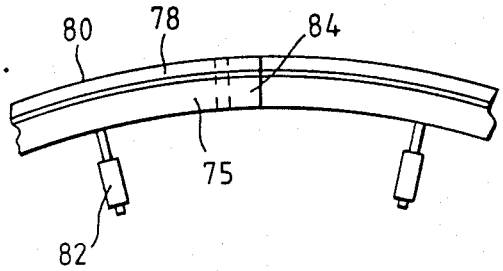
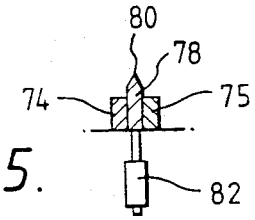
Fig.5.

TUNNEL BORING MACHINE

The present invention relates to tunnel boring machines.

Tunnel boring machines are of several types. One type includes a single shield with a cutting head at its forward end and a number of circumferentially spaced rearwardly movable hydraulic rams are spaced a short distance inwardly from the rear edge of the shield. These are used to push the shield forwardly from an already constructed tunnel lining behind the tunnel boring machine. The rear end of the shield extends outside the lining elements and the lining elements are, indeed, built within the shield and then pushed backwardly against the existing elements by these auxillary hydraulic rams.

Another form of tunnelling machine has a telescopic shield with a front, substantially cylindrical shield, a cutting head mounted at the forward end of the front shield, a rear substantially cylindrical shield mounted co-axially with respect to said front shield and telescopically arranged thereto. Radially extensible grippers are mounted on the rear shield and move radially outwardly to grip the wall of the tunnel cut by the cutting head and hydraulic rams are provided between the front and rear shield to move the front shield axially with respect to the rear shield. Such a machine is conventionally used with expansible concrete tunnel linings which are built behind the rear edge of the rear shield and may be pushed rearwardly, a "keystone" being forced in last to cause the expansion of the lining against the wall of the tunnel. Quite clearly such a construction of lining cannot be constructed within the rear shield because the radial expansion of the lining would have to be against the inner wall of the shield which would be impractical.

This second type of machine is conventionally used on harder ground where there is little if any likelihood of earth or water falling downwardly from the cut tunnel wall.

It is now proposed, according to the present invention, to provide a tunnel boring machine comprising a front, substantially cylindrical shield, a cutting head mounted at the forward end of said front shield, a rear substantially cylindrical shield mounted co-axially with respect to said front shield and telescopically arranged thereto, radially extensible grippers mounted on said rear shield and movable radially outwardly to grip the wall of the tunnel cut by said cutting head, hydraulic rams to move said front shield axially with respect to said rear shield, at least one shutter mounted on said rear shield between a forward, retracted position and a rearward extended position, in which latter position the or each shutter extends rearwardly of the rear-most edge of the rear shield, and a hydraulic ram associated with the or each shutter to move it between said positions.

With such a construction, if it appears that a problem may be arising with the quality of the soil or earth which is being cut by the tunnel boring machine, the shutter or shutters can be moved to their rearward extended position in which the free edges of the shutters abut against the already formed tunnel lining. The shutter or shutters thus provide the necessary protection for the workmen in the tunnel for a limited period.

While a single shutter may be provided which is fully cylindrical, or, for example, semi-cylindrical going only over the top part of the space between the rear of the shield and the front of the tunnel lining, in a preferred construction, there are provided a plurality of substantially segment shaped shutters each having its own auxillary hydraulic ram, said segment shaped shutters being circumferentially adjacent one another and individually movable by their associated auxillary hydraulic ram. Using these hydraulic rams, together with their shutters, one can force the individual segments of the expandable tunnel lining into place and in particular one can force in the "keystone".

In order to give better protection the adjacent shutters are preferably in mutually rubbing contact and at least some of the shutters advantageously include a first stage shutter movable rearwardly of the rear edge of the rear shield and a second stage shutter movable rearwardly relative to the first stage shutter.

When the shutters are in position, it is desirable that the auxillary hydraulic rams are designed to be uncoupled with respect to their associated shutters, whereby the shutters can be disconnected therefrom. Since the shutters will, if they make up a complete circle, in effect be self-supporting, they can simply then be cemented in and form part of the tunnel lining.

In case there is any problem of water seepage through the tunnel wall, it is advantageous for a fluid pressure expandable cuff to be provided to surround the front shield rearwardly of the cutter head, whereby a seal can be produced between the front shield and the surrounding cut tunnel wall. Additionally, or alternatively, a fluid pressure expandable cuff can be provided to surround the rear shield rearwardly of the radial movable grippers whereby a seal can be produced between the rear shield and the surrounding cut tunnel wall.

According to another aspect of the invention, there is provided a tunnel boring machine comprising a front substantially cylindrical shield, a cutter head mounted at the forward end of said front shield, a rear substantially cylindrical shield mounted co-axially with respect to said front shield and telescopically arranged relative thereto, radially extensible grippers mounted on said rear shield and movable radially outwardly to grip the wall of the tunnel cut by said cutting head, hydraulic rams to move said forward shield axially with respect to said rear shield, a fluid pressure operated cuff surrounding said forward shield rearwardly of said cutting head whereby a seal can be produced between the front shield and the surrounding cut tunnel wall.

The expansible cuff or cuffs can take many forms. It is comtemplated that they could take the form of an inflatable taourus. However, according to a preferred construction, the cuff is formed of a number of, preferably metal, circumferential blades which overlap adjacent their ends and an equal number of hydraulic ram assemblies associated with each of said blades. Preferably the blades are sharpened at their outer edges so that when they are urged radially outwardly the sharpened edges cut into the tunnel wall thereby improving the seal.

In order that the present invention will more readily be understood, the following description is given, merely by way of example, in which:

FIG. 1 is a very schematic cross-section through one embodiment of tunnel boring machine according to the invention;

Figure 2:
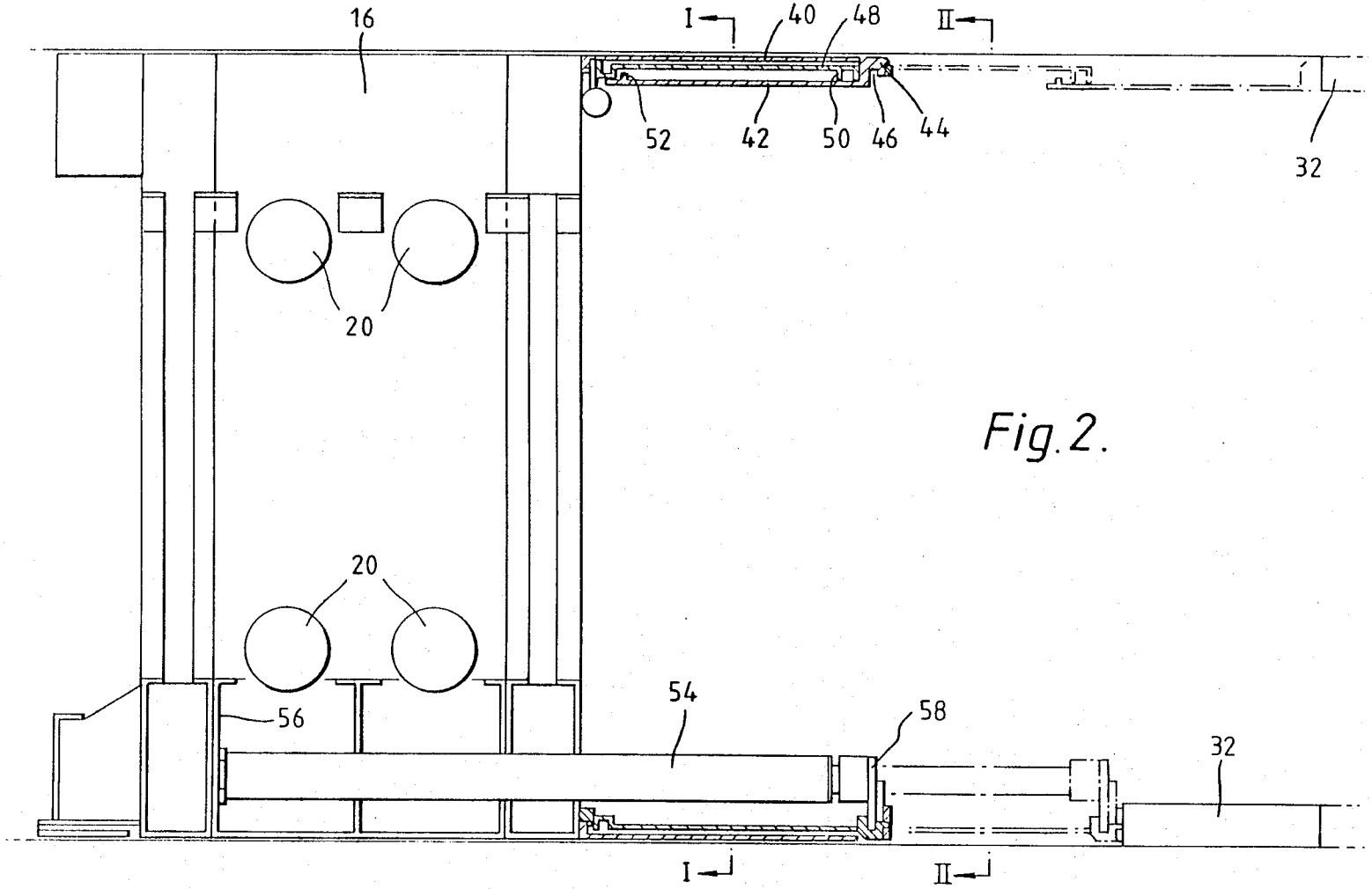
FIG. 2 is an enlarged cross-section through the rear portion of the machine of FIG. 1.
Figure 3:
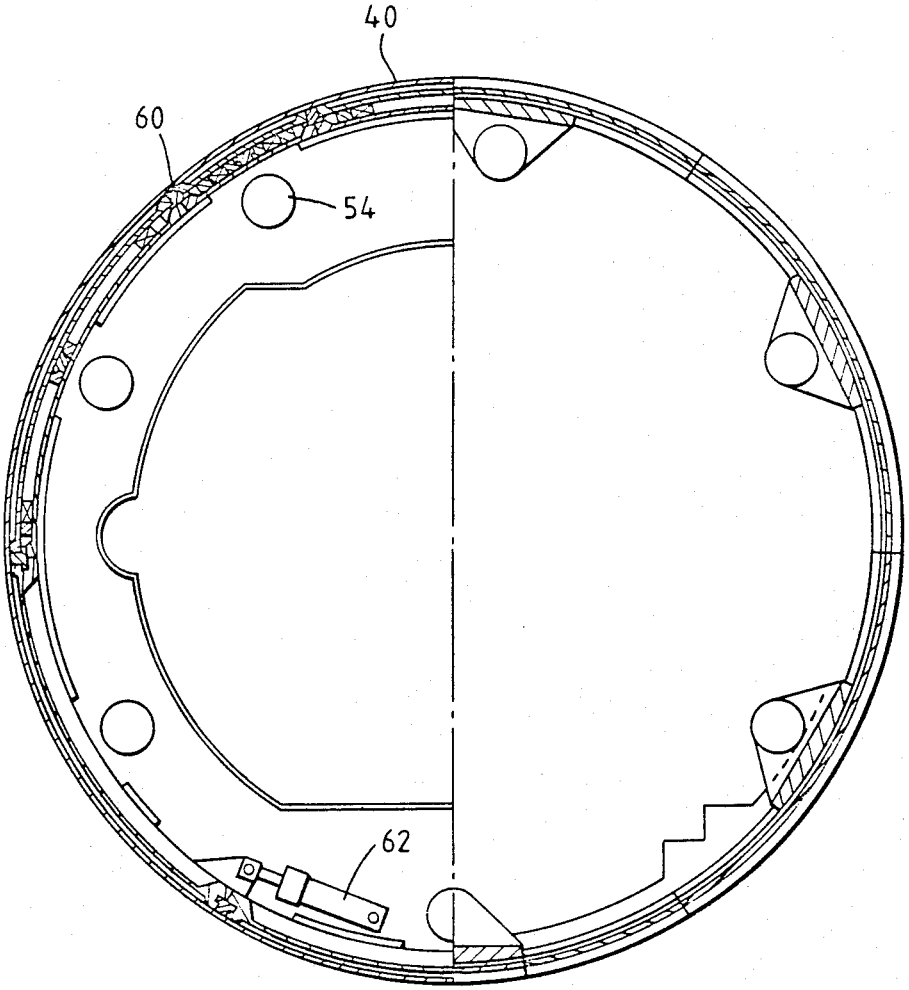

FIG. 3 includes two half sections along the lines I—I and II—II of FIG. 2;

FIG. 4 is a schematic view of one form of cuff member of the machine of FIG. 1; and FIG. 5 is a section through the cuff member of FIG. 4.

Referring to the drawings there is illustrated a tunnel boring machine according to the invention including a front substantially cylindrical front shield 10 having a bulkhead 12, adjacent its front edge, and a cutting head 14 which is illustrated very diagrammatically and without its drive mechanism.

Rearwardly of the front shield 10 is a further substantially cylindrical rear shield 16 of slightly smaller diameter than the shield 10 and telescopically fitted thereinto. Diagrammatically illustrated hydraulic actuating rams 18 are disposed at circumferentially spaced locations around the inner peripheries of the two shields to cause the shields to be moved axially relative to one another. Adjacent its rear end the rear shield is provided with radially outwardly extensible grippers 20 these being capable of being urged outwardly by hydraulic rams (not shown) so as to be engagable with the wall 22 of the tunnel cut by the cutting head 14. Extending longitudinally through the two shields is a conveyor 24 for conveying away cut earth, rock etc and this passes through an opening 26 in the bulkhead 12. Means (not shown) are provided to move the conveyor rearwardly whereupon a door 28 can be pivoted to a shut position by a further hydraulic ram 30.

It will be seen from FIG. 1 that tunnel lining elements of the expandable type are indicated at 32 and are built in the tunnel immediately behind the tunnelling machine. However, there is an unsupported gap 34 between the rear edge 36 of the rear shield 16 and the leading edge of the last positioned tunnel lining element 32. This will normally be perfectly satisfactory if the earth through which one is boring the tunnel is firm and not subject to leakage. However, occasionally a problem can occur in which earth, rocks or water can start falling, which would obviously be dangerous to anybody working within the tunnel.

If reference is now made to FIGS. 2 and 3, it will be seen that to the rear of the rear shield 16 is attached a tubular tail skin 40 within which are mounted primary axially movable segment shaped first stage shutters 42 provided at their outer edges with an enlarged head 44 having a groove 46 therein. Within the upper first stage shutters 42 are second stage shutters 48 having a rib 50 engagable by a co-operating rib 52 on the first stage shutter 42. As can be seen at the lower side of the Figure, hydraulic rams 54 extend from a bulkhead 56 forwardly of the radial grippers 20 to a position within the tail skin 40. The piston rods of the rams 54 have associated therewith keying plates 58 which are engagable in the grooves 46 of the primary shutters 42. Thus, when one needs, in an emergency, to provide cover, the rams 54 are actuated and they are forced rearwardly thereby taking with them the first stage shutter 42 and, if there is adequate space, also the second stage shutters with the two ribs 50 and 52 engaging and thereby pulling the second stage shutter 48 with them.

The lower shutters do not have the second stage portions.

The actual construction of the shutters can be seen morely clearly from FIG. 3. It will be seen that guides 60 extend axially within the tail section 40 and in these are slidable both the first and second. These guides assist in the control of the movement of the first stage and second stage shutters the side edges of which are in sliding rubbing contact thereby to provide a complete shield. If desired, a slew cylinder 62 can be provided to allow the shutters to be slewed relative to the tail skin 40.

FIG. 1 illustrates also front and rear expandable cuffs 70 and 72 which have been omitted from FIGS. 2 and 3 for clarity. As can be seen from FIGS. 4 and 5, these each comprise front and rear circumferential guide rings 74, 76 with a blade 78 interposed therebetween, the blade having a sharpened edge 80 and being radially outwardly movable by a hydraulic ram 82.

The ends of the blades are rebated at 84 so that they form a sliding lapped joint, the portion on each side having a single chamfer to provide the edge 80.

Occasionally it will be desirable to produce a complete seal between the relevant shield and the tunnel wall in which case the rams 82 are actuated and the blades 78 will then be urged radially outwardly to engage the tunnel wall with the sharpened edge cutting into the tunnel wall. This can provide an effective seal preventing the ingress of water into the interior of the shield. At the same time the conveyor 24 can be retracted and the door 28 shut using the ram 30.

I claim:

1. A tunnel boring machine comprising a front, substantially cylindrical shield, a cutting head mounted at the forward end of said front shield, a rear substantially cylindrical shield mounted co-axially with respect to said front shield and telescopically arranged thereto and having a rearmost edge, radially extensible grippers mounted on said rear shield forwardly of said rearmost edge and movable radially outwardly to grip the wall of the tunnel cut by said cutting head, hydraulic rams to move said front shield axially with respect to said rear shield, at least one shutter mounted on said rear shield, means mounting said at least one shutter for movement axially of said machine between a forward, retracted position and a rearward extended position, in which latter position said at least one shutter extends rearwardly of the rear-most edge of the rear shield, and an auxiliary hydraulic ram associated with said at least one shutter to move it between said positions.

2. A tunnel boring machine as claimed in claim 1, wherein there are a plurality of substantially segment shaped shutters each having its own auxillary hydraulic ram, said segment shaped shutters being circumferentially adjacent one another and individually movable by their associated auxillary hydraulic ram.

3. A tunnel boring machine as claimed in claim 2, wherein the adjacent shutters are in mutual rubbing contact.

4. A tunnel boring machine as claimed in claim 2, wherein at least some of said shutters include a first stage shutter movable rearwardly of the rear edge of the rear shield and a second stage shutter movable rearwardly relative to said first stage shutter.

5. A tunnel boring machine as claimed in claim 2, wherein said auxillary hydraulic rams are designed to be uncoupled with respect to their associated shutters whereby the shutters can be disconnected therefrom whenin their rearward extended position.

6. A tunnel boring machine as claimed in claim 1, and further comprising means whereby the shutter or assembly of shutters can be circumferentially slewed relative to the rear shield.

7. A tunnel boring machine as claimed in claim 1, and further comprising a fluid pressure expandable cuff said cuff having at least one blade portion at its outmost edge surrounding said front shield rearwardly of the cutter head, whereby a seal can be produced between the front shield and the surrounding cut tunnel wall.

8. A tunnel boring machine as claimed in claim 1, and further comprising a fluid pressure expandable cuff surrounding said rear shield rearwardly of the radially extensible grippers whereby a seal can be produced between the rear shield and the surrounding cut tunnel wall.

9. A tunnel boring machine as claimed in claim 1, wherein said auxillary ram or rams extend from a position forwardly of said radially extensible grippers.

10. A tunnel boring machine comprising a front substantially cylindrical shield, a cutter head mounted at the forward end of said front shield, a rear substantially cylindrical shield mounted co-axially with respect to said front shield and telescopically arranged relative thereto and having a rearmost edge, radially extensible grippers mounted on said rear shield forwardly of said rearmost edge and movable radially outwardly to grip the wall of the tunnel cut by said cutting head, hydraulic rams to move said front shield axially with respect to said rear shield and a fluid pressure operated expandable cuff surrounds said front shield rearwardly of said cutting head whereby a seal can be produced between the front shield and the surrounding cut tunnel wall, said cuff having at least one blade portion at its outermost edge.

11. A tunnel boring machine as claimed in claim 10, and further comprising a fluid pressure expansible cuff mounted to said rear shield rearwardly of said gripper means whereby a seal can be produced between the rear shield and the surrounding cut tunnel wall.

* * * * *